US007458900B1

(12) United States Patent
Park

(10) Patent No.: US 7,458,900 B1
(45) Date of Patent: Dec. 2, 2008

(54) SPORTS SWING TRAINING AID

(76) Inventor: Glenn Park, 6965 Abbottswood Dr., Rancho Palos Verdes, CA (US) 90275-3021

( * ) Notice: Subject to any disclaimer, the term of this patent is extended or adjusted under 35 U.S.C. 154(b) by 0 days.

(21) Appl. No.: 11/973,192

(22) Filed: Oct. 5, 2007

(51) Int. Cl.
*A63B 69/36* (2006.01)

(52) U.S. Cl. ..... 473/228; 473/226; 473/437

(58) Field of Classification Search ..... 473/219, 473/223, 226, 228, 257, 422, 437, 451, 457
See application file for complete search history.

(56) References Cited

U.S. PATENT DOCUMENTS 3,809,397 A * 5/1974 Gruenewald ..... 473/457
5,207,625 A * 5/1993 White ..... 482/111
6,881,156 B1 * 4/2005 Phillips ..... 473/228
7,112,152 B1 * 9/2006 Chen ..... 473/457
7,118,490 B2 * 10/2006 Namba ..... 473/228
2003/0207719 A1 * 11/2003 Hughes ..... 473/228

* cited by examiner

*Primary Examiner*—Nini Legesse
(74) *Attorney, Agent, or Firm*—Robert R. Meads

(57) ABSTRACT

An air resistance appliance that is easily attached to the shaft of a golf club or a baseball bat and that is quickly and easily collapsed into a small, lightweight package for storage or transport with the user as in his or her golf bag.

6 Claims, 5 Drawing Sheets

SPORTS SWING TRAINING AID

FIELD OF INVENTION

The present invention relates to sports training equipment and, more particularly, to an aid useful in the training of a user to properly swing sports equipment including an elongated shaft, such as a golf club or a baseball bat.

BACKGROUND OF INVENTION

The upper body muscle strength and the ability to recognize the proper release point for uncocking of ones wrists just before the hitting of a ball are important in the proper hitting of a ball both in golf and in baseball. In order to develop upper body muscle strength it is common to use weighted clubs and bats sometimes by adding "doughnut" like accessories to the club or bat during practice swinging. Upper body strength also may be improved by the adding of wind resistance appliances to a golf club or baseball bat at least during practice swinging of the club or bat.

Wind resistance appliances have the advantage of being relatively lightweight and of adding swinging resistance only during the swinging process. Such wind resistance appliances also have the advantage of slowing down the club and bat movement allowing the user to better detect the proper release point during his or her swinging of the club or bat. Also, wind resistance appliances are less prone to cause user injury when compared to weighted clubs that produce strenuous and jerky swinging motions. Unfortunately however, prior wind resistance appliances such as those described and illustrated in U.S. Pat. No. 6,881,156 issued Apr. 19, 2005 have been difficult to attach to a golf club and have been awkward to carry and to store.

Accordingly, there is a continuing need for an improved wind resistance appliance that is easy to attach and capable of being easily collapsed into a compact package for storage or transport by the user. The present invention satisfies that need.

SUMMARY OF INVENTION

The present invention comprises an air resistance appliance that is easily attached to the shaft of a golf club or a baseball bat and is quickly and easily collapsed into a small, lightweight package for storage or transport with the user, as in his or her golf bag. Basically, the appliance of the present invention comprises a circumferentially foldable air resistance sports training aid for use during the swinging of an elongated shaft such as included a golf club or a baseball bat.

The aid comprises a circumferentially foldable axially elongated substantially cylindrical central hub for releasable locking to the elongated shaft of a golf club or baseball bat. The central hub is formed from a plurality of semi-cylindrical hub sections. Each hub section includes an arc-like inner surface. Preferably, the inner surface is shaped to conform to and engage a circumferential portion of the elongated shaft. Each hub section also includes an axially extending edge hinged to an adjacent hub section to swing outwardly away from the adjacent hub section to form an elongated opening for receiving the elongated shaft and to swing inward toward the adjacent hub section to combine with other of the hub sections to form a substantially cylindrical inner hub surface for engaging and locking to the elongated shaft.

A plurality of the hub sections also include an outer surface carrying an outwardly extending vertical channel for releasably and vertically receiving a paddle-like blade extending radially from the hub. The blades are detachable from the hub and may be replaced with difference size blades for different levels of wind resistance.

The aid further comprises one or more user operable latches each secured to a first end-most one of the plurality of hub sections for releasably locking the first end-most hub section to a second end-most hub section of the central hub to tightly and releasably secure the central hub to the elongated shaft with the plurality of blades extending radially outward from the central hub to provide wind resistance to a swing of the elongated shaft by a user while allowing for a simple collapsing of the aid into a compact easily transportable package. Preferably, at least one of the latches is spring loaded to insure that the central hub tightly locks to the elongated shaft of the golf club or baseball bat while to plurality of blade extend radially from the central hub to create air resistance to a swinging of the club or bat.

The structure and operation of the present invention may be more clearly understood by reference to the following detailed description when considered with the drawings as described below.

DETAILED DESCRIPTION OF INVENTION

Figure 5:
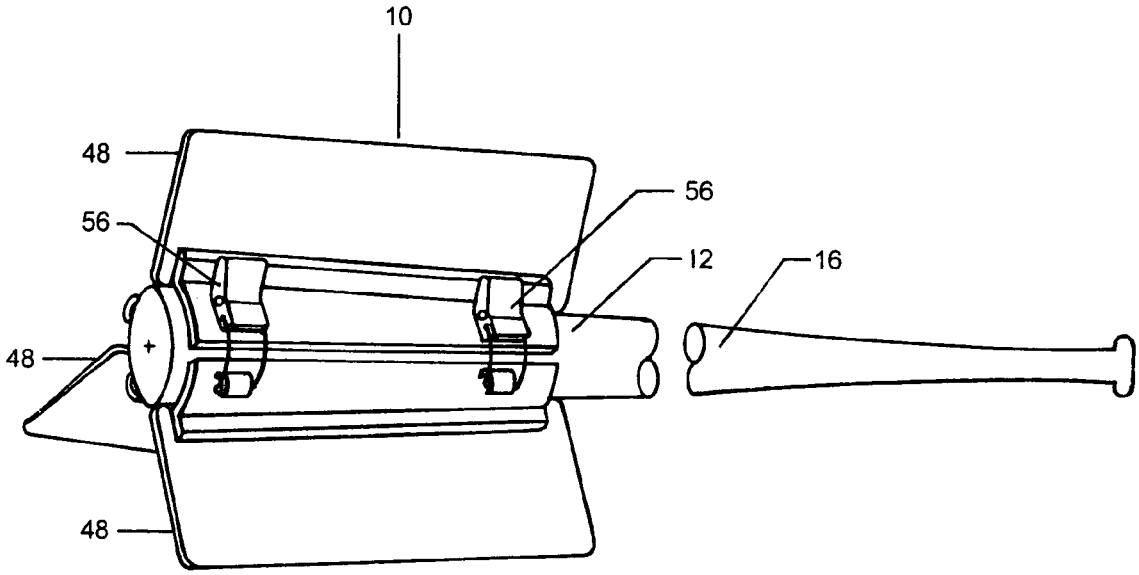
FIG. 5 is a fragmentary perspective view of a second version of the appliance of the present invention releasably secured to an elongated shaft of a baseball bat.

The present invention comprises an air resistance appliance 10 that is easily attached to the shaft 12 of a golf club 14 (see FIG. 1) or a baseball bat 16 (see FIG. 5) and is quickly and easily collapsed into a small, lightweight package for storage or transport with the user as in his or her golf bag.

Figure 3:
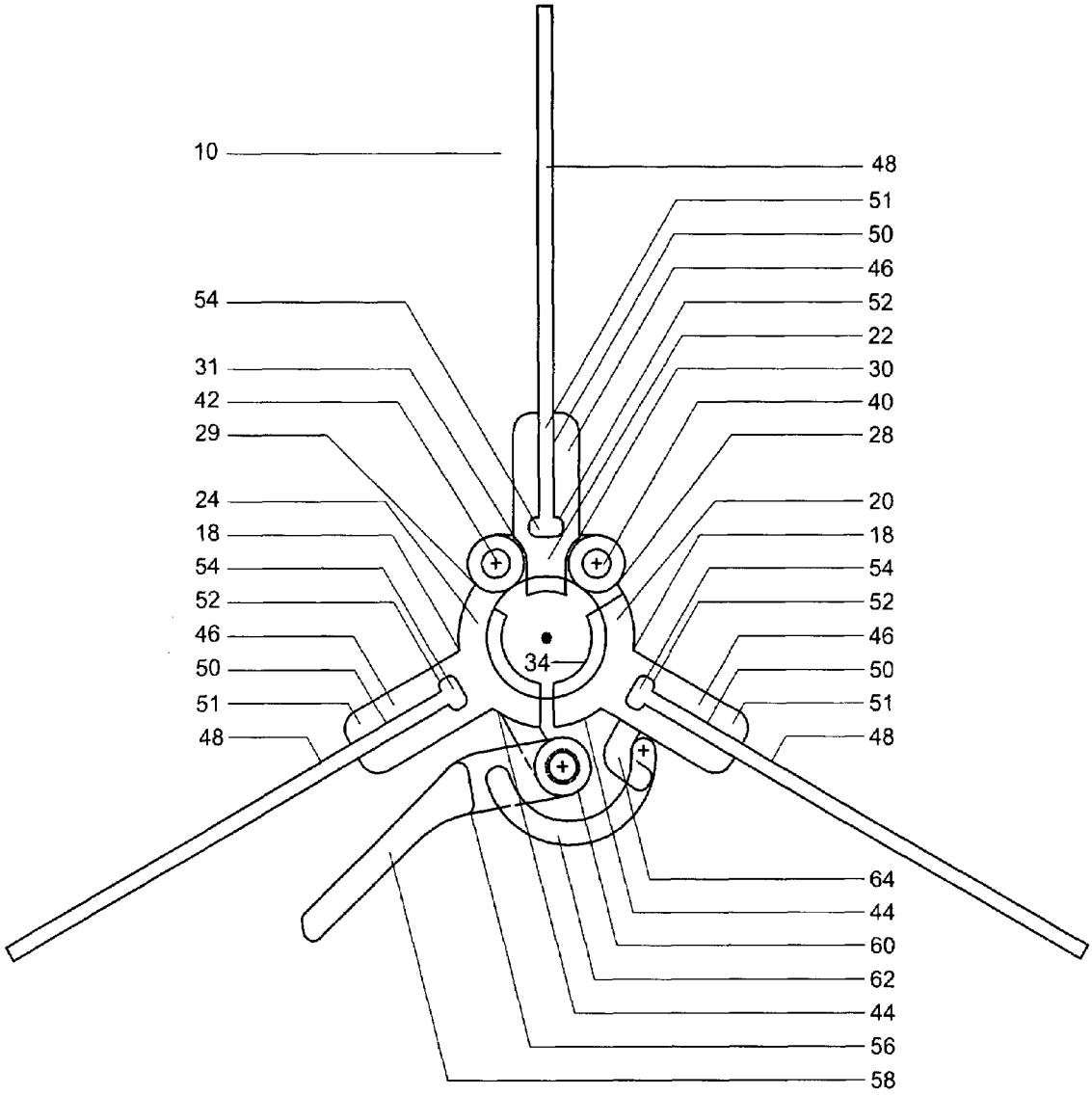
FIG. 3 is a top view of the appliance as shown in FIG. 1.

Basically, the appliance 10 comprises a circumferentially foldable axially elongated substantially cylindrical central hub 18 for releasable locking to the elongated shaft 12 of a golf club or baseball bat. As shown in FIG. 3, the central hub 18 is formed from a plurality of vertically extending semi-cylindrical hub sections 20, 22, 24. Each hub section includes an arc-like inner surface 26 each shaped to conform to and engage a different circumferential portion of the elongated shaft 12.

Figure 4:
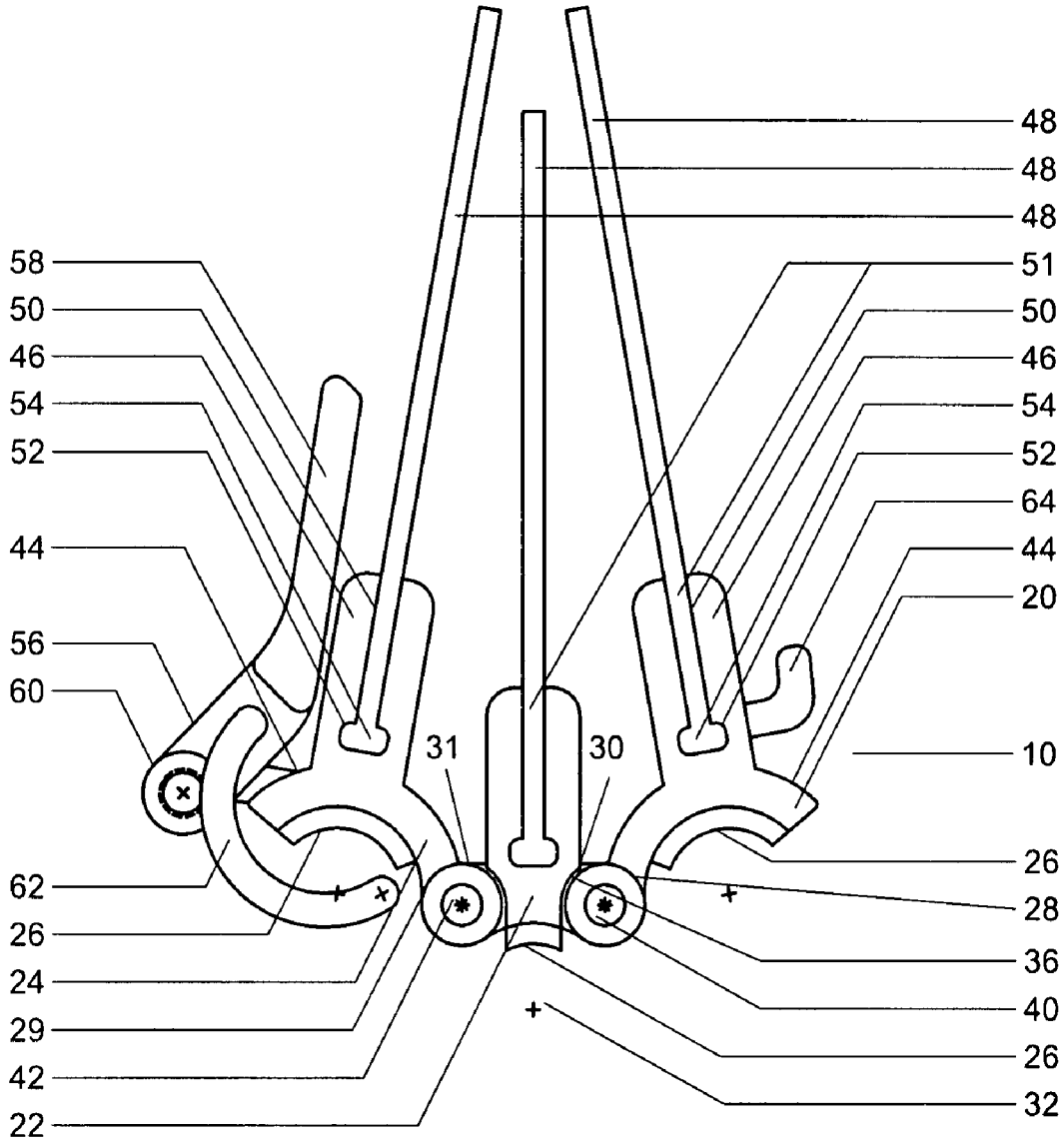
FIG. 4 is a top view of the appliance as shown in FIG. 2.

As shown in FIG. 4, the hub sections 20 and 24 define end-most ones of the plurality of hub sections and include axially extending edges 28 and 29 hinged respectively to opposite axially extending edges 30 and 31 of the hub section 22 defining a central one of the plurality of hub sections.

Figure 1:
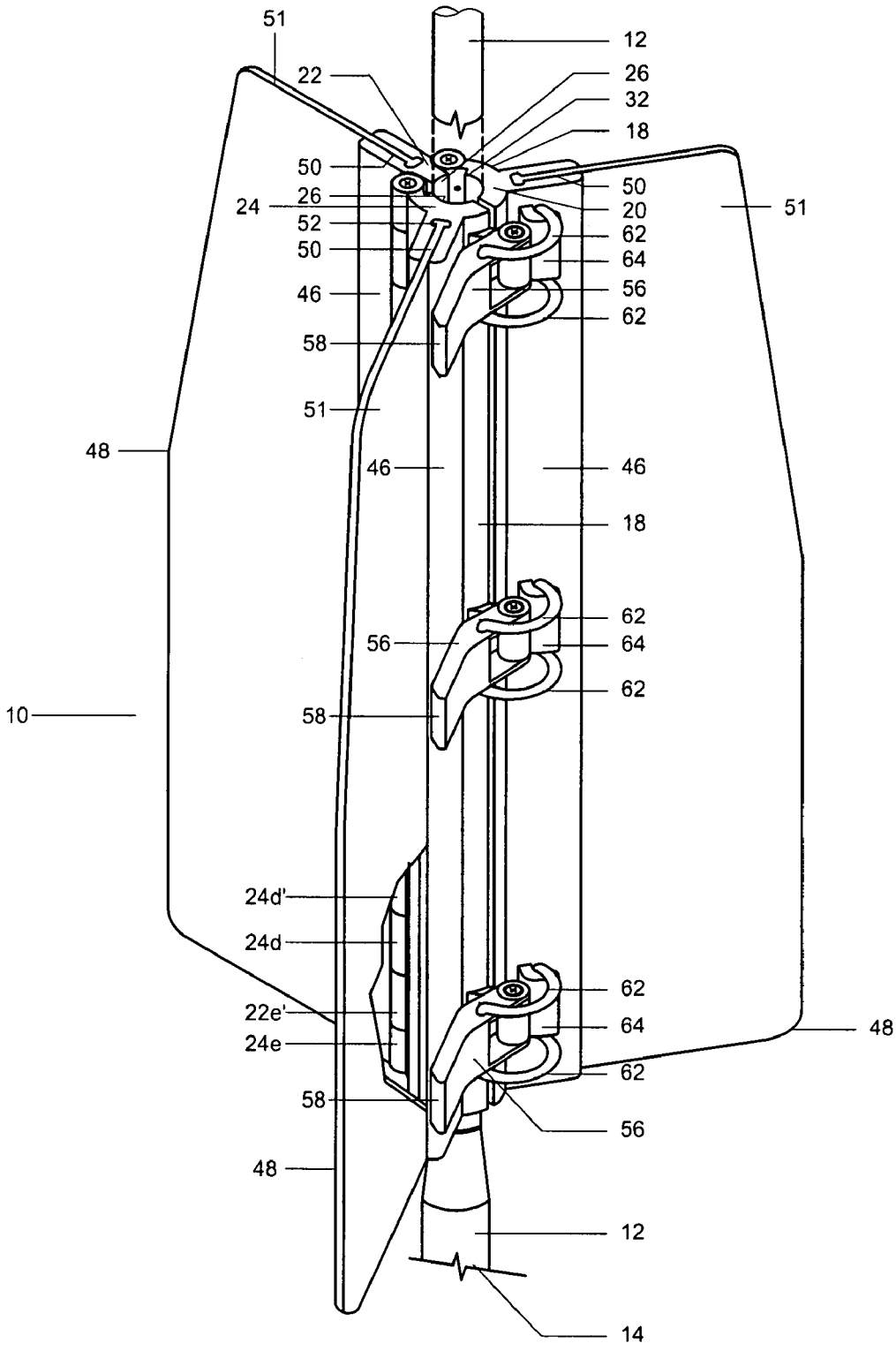
FIG. 1 is a fragmentary perspective view of one version of the appliance of the present invention releasably secured to an elongated shaft of a golf club.
Figure 2:
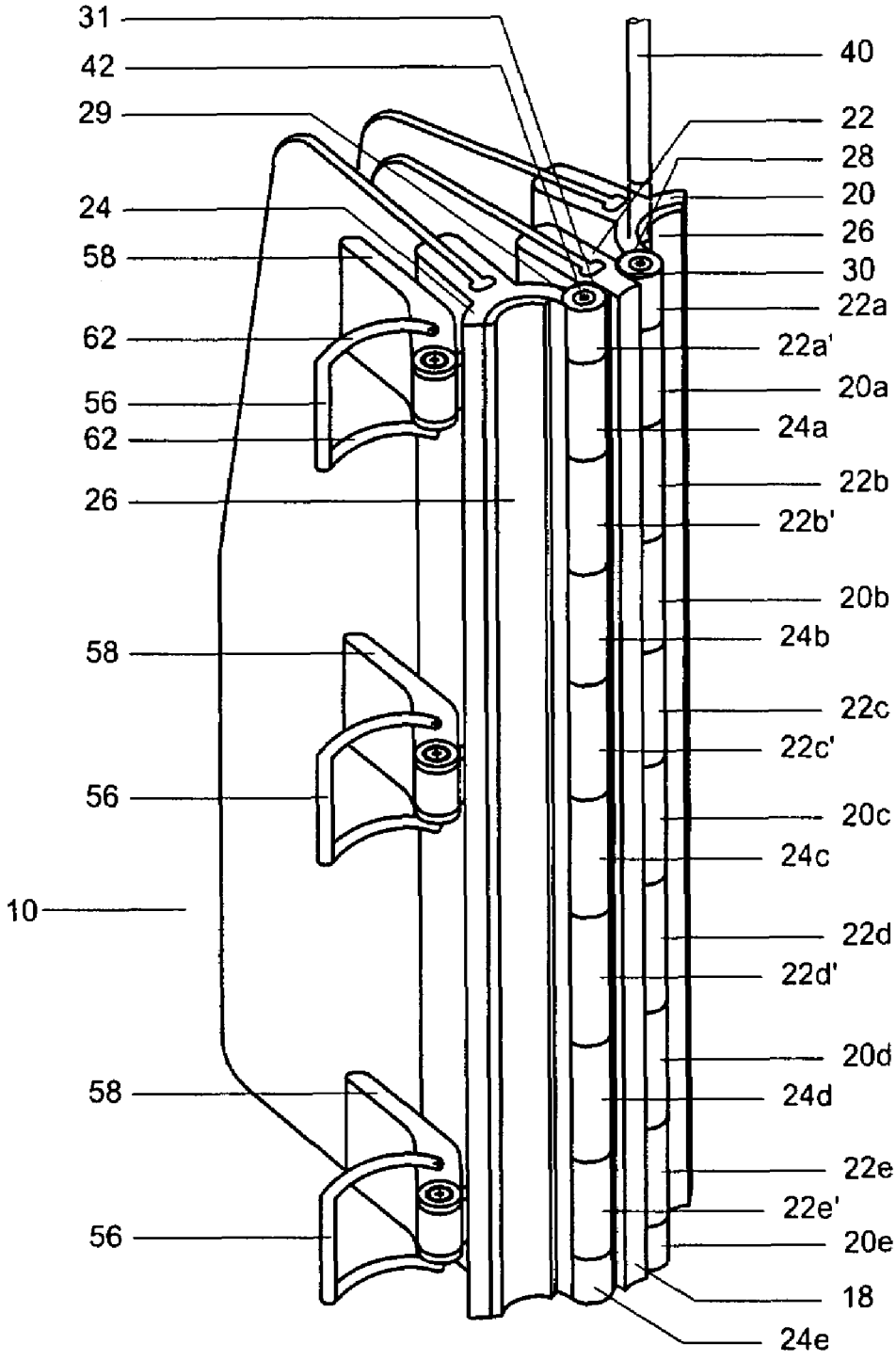
FIG. 2 is a fragmentary perspective view of the FIG. 1 version of the appliance released from the elongated shaft of the golf club and shown in its fully collapsed condition illustrating the hinge connection of the sections of the central hub of the appliance.

In this respect, as illustrated in FIGS. 3 and 4, the end-most hub sections 20 and 24 are hinged to swing outwardly away from the central hub section 22 to form an elongated opening 32 for receiving the elongated shaft 12 and to swing inward toward the central hub section 22 and to combine therewith to form a substantially cylindrical inner hub surface 34 for engaging and locking to the elongated shaft (see FIGS. 1 and 3). More specifically, as depicted in FIG. 2, the axially extending edges 28 and 29 of the end-most hub sections 20 and 24 respectively include a series of vertically spaced cylindrical hinge sections 20*a*,20*b*,20*c*,20*d*,20*e* and 24*a*,24*b*,24*c*,24*d*,24*e*. The hinge sections 20*a*-20*e* and 24*a*-24*e* are respectively interleaved with vertically spaced cylindrical hinge sections 22*a*,22*b*,22*c*,22*d*,22*e* and 22*a*',22*b*',22*c*',22*d*',22*e*' extending from the opposite vertically extending edges 30 and 31 of the central hub section 22. When the hinge sections are so interleaved and vertically aligned, open through-holes are formed that receive vertical pins 40 and 42 about which the hinges pivot between open (FIGS. 2 and 4) and closed (FIGS. 1 and 3) positions.

The plurality of the hub sections 20, 22, 24 also include outer surfaces 44 each carrying a radially and outwardly extending vertical channel 46 for vertically and releasably receiving a replaceable paddle-like blade 48 extending radially from the hub 18. Blades of different size and wind resistance characteristics may be inserted into the channels 46 to tailor the wind resistance to the needs of the user of the appliance 10. In these regards, each blade receiving channel 46 includes a vertical radially extending channel portion 50 for vertically receiving a main vertical portion 51 of each blade 48 and a laterally extending channel portion 52 at an inner radial end of the vertically extending channel portion 50. Each blade 48 vertically received in a channel 46 includes a vertical laterally extending portion 54 for extending into the lateral channel portion 52 to secure the blade against radial movement out of the channel.

In addition to the foregoing, the appliance 10 further comprises one or more user operable latches 56 each secured to a first end-most section 20 of the plurality of hub sections 20, 22, 24 for releasably locking the first end-most hub section 20 to the second end-most hub section 24 of the central hub 18 to tightly and releasably secure the central hub to the elongated shaft 12. Thus secured, the plurality of blades 48 extending radially from the central hub 18 provide wind resistance to a swinging of the elongated shaft 12 by a user while allowing for a simple collapsing of the aid into a compact easily transportable package (see FIG. 2).

Preferably, at least one of the latches 56 is spring loaded to insure that the central hub 18 tightly locks to the elongated shaft 12 of the golf club 14 or baseball bat 16 (FIG. 5) while the plurality of blades 48 extend radially from the central hub to create air resistance to a swinging of the club or bat. In these regards, each latch 56 preferably includes a user actuated arm 58 hinged at one end 60 to the end-most hub section 24 and carrying an arcuate spring hook 62 for latching to a catch 64 on the end-most hub section 20 of the central hub as shown in FIGS. 1 and 3.

While in the foregoing, a preferred embodiment of the present invention and a preferred mode of operation thereof have been described and illustrated in detail, changes and modifications may be made without departing from the spirit of the present invention. Accordingly the present invention is to be limited in scope only by the following claims.

The invention claimed is:

1. An air resistance appliance that is easily attached to the shaft of a golf club or a baseball bat and that is quickly and easily collapsed into a small, lightweight package for storage or transport with the user as in his or her golf bag, comprising:

a circumferentially foldable axially elongated substantially cylindrical central hub for releasable locking to the elongated shaft of a golf club or baseball bat, the central hub being formed from a plurality of semi-cylindrical hub sections each hub section including an arc-like inner surface and an axially extending edge hinged to an adjacent hub section to swing outwardly away from the adjacent hub section to form an elongated opening for receiving the elongated shaft and to swing inward toward the adjacent hub section to combine with other of the hub sections to form a substantially cylindrical inner hub surface for engaging and locking to the elongated shaft;

a plurality of the hub sections also each include an outer surface carrying an outwardly extending vertical channel for releasably and axially receiving a paddle-like blade extending radially from the hub; and one or more user operable latches each secured to a first end-most one of the plurality of hub sections for releasably locking the first end-most hub section to a second end-most hub section of the central hub to tightly and releasably secure the central hub to the elongated shaft with the plurality of blades extending radially from the central hub to provide wind resistance to a swinging of the elongated shaft by a user while allowing for a simple collapsing of the appliance into a compact easily transportable package.

2. The appliance of claim 1 wherein at least one of the latches is spring loaded to insure that the central hub tightly locks to the elongated shaft of the golf club or baseball bat while a plurality of blades extend radially from the central hub to create air resistance to a swinging of the club or bat.

3. The appliance of claim 1 wherein the inner surface of each hub section is shaped to conform to and engage a circumferential portion of the elongated shaft.

4. The appliance of claim 1 wherein the longitudinally extending edge of each hub section hinged to an adjacent hub section and each adjacent hub section includes a series of vertically spaced cylindrical hinge sections interleaved with a series of vertically spaced cylindrical hinge sections and receiving a vertical pin about which the hinge sections rotate between open and closed positions.

5. The appliance of claim 1 wherein the blade receiving channels each include a vertical radially extending channel portion for vertically receiving a main portion of each blade and a laterally extending channel portion at an inner radial end of the vertical extending channel portion and each blade received in a channel includes a vertical laterally extending portion for extending into the lateral channel portion to secure the blade against radial movement out of the channel.

6. The appliance of claim 1 wherein each latch includes a user actuated latch arm hinged at one end to the first end-most hub section and including a second end for latching to a catch on the second end-most hub section of the central hub.

* * * * *